US011492805B2

(12) United States Patent
Yang et al.

(10) Patent No.: US 11,492,805 B2
(45) Date of Patent: Nov. 8, 2022

(54) MEMBRANE INSTALLATION METHODS

(71) Applicant: Building Materials Investment Corporation, Dallas, TX (US)

(72) Inventors: Li-Ying Yang, Whippany, NJ (US); Jeffrey Avitabile, Lodi, NJ (US); Joseph Nigro, Wayne, NJ (US); Daniel Podewils, Evansville, IN (US); Brian A. Davis, Kennett Square, PA (US); Eric R. Anderson, Montclair, NJ (US); Matthew Gimpert, Stewartsville, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 64 days.

(21) Appl. No.: 17/156,004

(22) Filed: Jan. 22, 2021

(65) Prior Publication Data

US 2021/0230876 A1 Jul. 29, 2021

Related U.S. Application Data

(60) Provisional application No. 62/965,286, filed on Jan. 24, 2020.

(51) Int. Cl.

| | |
|---|---|
| ***E04D 5/14*** | (2006.01) |
| ***E04D 3/36*** | (2006.01) |
| *E04D 15/04* | (2006.01) |

(52) U.S. Cl.

CPC ..... *E04D 5/145* (2013.01); *E04D 3/3603* (2013.01); *E04D 5/142* (2013.01); *E04D 2015/047* (2013.01)

(58) Field of Classification Search

CPC ..... E04D 5/145; E04D 3/3603; E04D 5/142; E04D 2015/047; E04D 13/064; E04D 13/155; E04D 5/146

See application file for complete search history.

(56) References Cited

U.S. PATENT DOCUMENTS 4,588,637 A * 5/1986 Chiu ..... E04D 5/148 428/521

5,498,385 A 3/1996 Yabusa et al.

(Continued)

FOREIGN PATENT DOCUMENTS

| | | |
|---|---|---|
| EP | 1325992 B1 | 9/2005 |
| WO | 2015/089384 A1 | 6/2015 |

*Primary Examiner* — Patrick J Maestri

(74) *Attorney, Agent, or Firm* — Greenberg Traurig, LLP

(57) ABSTRACT

A method includes obtaining a roofing membrane. A first layer of the roofing membrane is applied along a length of a roofing substrate covering a first portion of the roofing substrate. At least a first edge of the first layer is fastened to the roofing substrate. A second layer of the roofing membrane is applied over the first layer along the length of the roofing substrate such that a first edge of the second layer overlies the second edge of the first layer. The first edge of the second layer and the second edge of the first layer are fastened to the roofing substrate using a second fastener in a fastening zone along the length the roofing substrate. The second layer is reoriented such that the second layer overlies the fastening zone and covers a second portion of the roofing substrate adjacent the first portion of the roofing substrate.

17 Claims, 6 Drawing Sheets

(56) References Cited

U.S. PATENT DOCUMENTS

| | | | | |
|---|---|---|---|---|
| 5,797,232 | A * | 8/1998 | Larson | E04D 5/149 411/164 |
| 6,070,629 | A | 6/2000 | Whiteside | |
| 6,833,333 | B2 | 12/2004 | Reisdorf et al. | |
| 10,458,120 | B1 * | 10/2019 | Zhang | E04D 1/18 |
| 2004/0127614 | A1 | 7/2004 | Jiang et al. | |
| 2004/0161569 | A1 | 8/2004 | Zanchetta et al. | |
| 2006/0201094 | A1 * | 9/2006 | Lassiter | E04D 1/265 52/518 |
| 2007/0193167 | A1 | 8/2007 | Bruce et al. | |
| 2009/0107073 | A1 * | 4/2009 | Kalkanoglu | E04D 5/12 428/141 |
| 2010/0173112 | A1 | 7/2010 | Wiercinski | |
| 2011/0033685 | A1 * | 2/2011 | Folkersen | B32B 11/046 156/289 |
| 2013/0247490 | A1 | 9/2013 | Strait | |
| 2016/0348286 | A1 | 12/2016 | Arthurs | |
| 2017/0306628 | A1 | 10/2017 | Simonis et al. | |
| 2019/0055734 | A1 | 2/2019 | Lennox | |
| 2019/0309519 | A1 | 10/2019 | Folkersen et al. | |

* cited by examiner

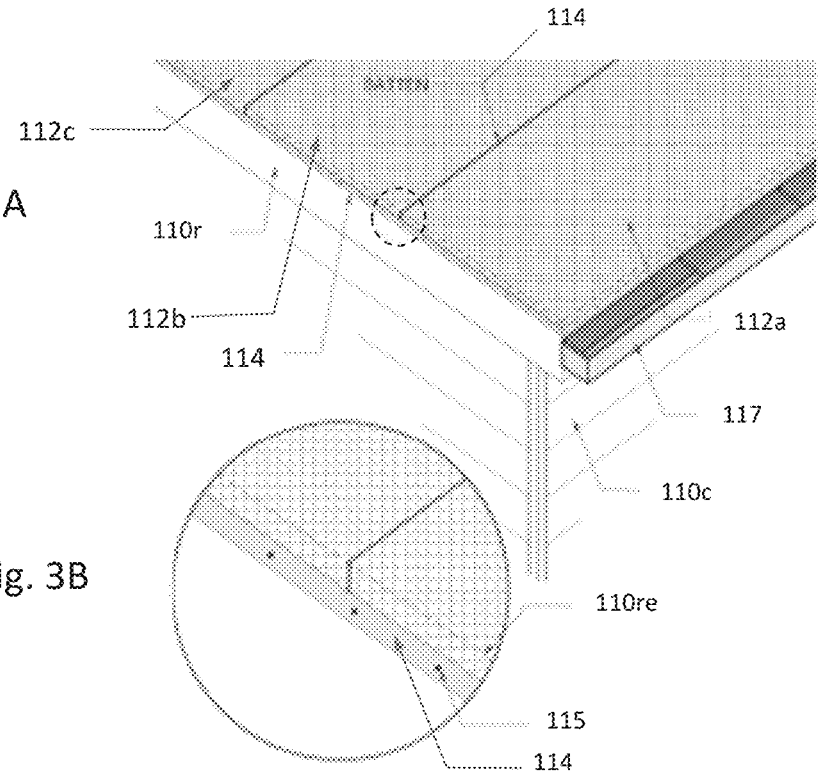
Fig. 3A
Fig. 3B
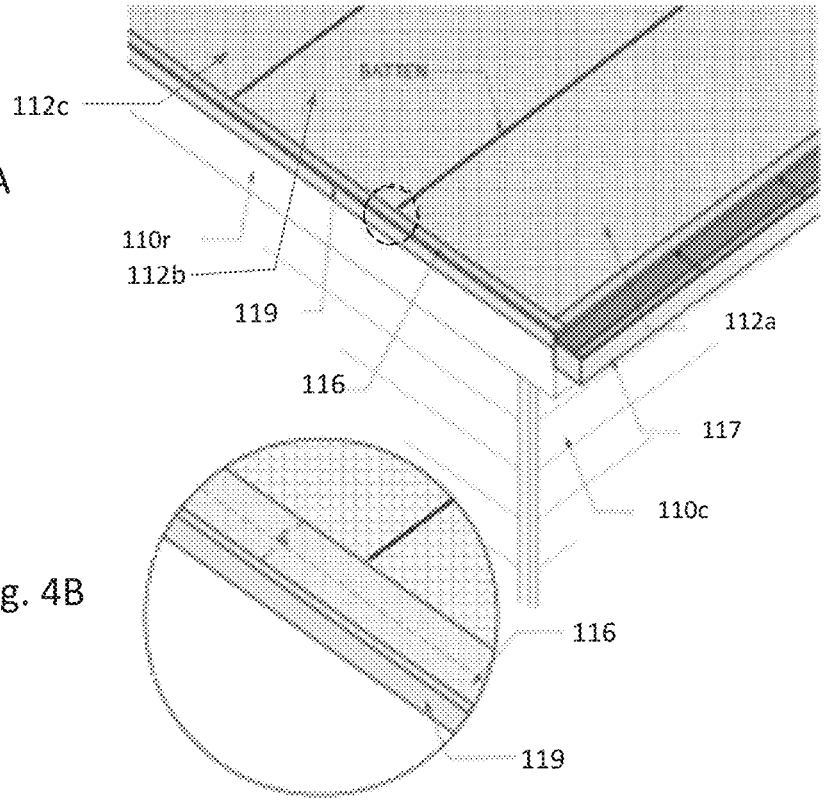
Fig. 4A
Fig. 4B

MEMBRANE INSTALLATION METHODS

CROSS-REFERENCE TO RELATED APPLICATIONS

This application claims the benefit of U.S. Provisional Application No. 62/965,286, entitled "MEMBRANE INSTALLATION METHODS," filed on Jan. 24, 2020, the entirety of which is hereby incorporated by reference.

FIELD

The present disclosure relates to improved methods for the installation of roofing materials. More particularly, this disclosure relates to methods for the installation of roofing materials including roofing membranes on a roofing substrate.

BACKGROUND

A single ply building membrane is a roofing membrane typically applied in the field using a one-layer membrane material (either homogeneous or composite) rather than multiple layers built-up, for instance, as with asphaltic shingles. The membranes can include one or more layers, have a top and bottom surface, and may include a reinforcing scrim or stabilizing material.

SUMMARY

In some embodiments, methods of applying a roofing membrane to a roofing substrate having a length and a width are provided. In some embodiments, the methods include obtaining a roofing membrane, applying a first layer of the roofing membrane along the length of the roofing substrate such that the first layer of the roofing membrane covers a first portion of the roofing substrate, the first layer of the roofing membrane having a first edge and a second edge opposite the first edge, fastening at least the first edge of the first layer of the roofing membrane to the roofing substrate along the length the roofing substrate using a first fastener, applying a second layer of the roofing membrane over the first layer of the roofing membrane along the length of the roofing substrate, the second layer of the roofing membrane having a first edge and a second edge opposite the first edge, such that the first edge of the second layer of the roofing membrane overlies the second edge of the first layer of the roofing membrane, fastening the first edge of the second layer of the roofing membrane and the second edge of the first layer of the roofing membrane to the roofing substrate using a second fastener in a fastening zone along the length the roofing substrate, and reorienting the second layer of the roofing membrane such that the second layer of the roofing membrane overlies the fastening zone and covers a second portion of the roofing substrate adjacent the first portion of the roofing substrate.

In some embodiments, applying the first layer of the roofing membrane includes unrolling the first layer of the roofing membrane from a first roll, and applying the second layer of the roofing membrane comprises unrolling the second layer of the roofing membrane onto the roofing substrate from a second roll. In some of these embodiments, the first and second rolls are the same. In some of these embodiments, the first and second rolls are different.

In some embodiments, which may be used in conjunction with any of the above aspects and embodiments, a width of the roofing membrane may range from 0.25 feet to 12 feet.

In some embodiments, which may be used in conjunction with any of the above aspects and embodiments, the roofing membrane may be a single-ply reinforced or unreinforced roofing membrane.

In some embodiments, which may be used in conjunction with any of the above aspects and embodiments, the first and second fasteners may be the same or the first and second fasteners may be different.

In some embodiments, which may be used in conjunction with any of the above aspects and embodiments, the first and second fasteners may be independently selected from one or more of the following: an adhesive tape, an adhesive layer that is applied on a surface of one or both of the first and second layers of the roofing membrane, a penetrating member (e.g., selected from nails, screws, staples, etc.), and a strip of material.

In some embodiments, which may be used in conjunction with any of the above aspects and embodiments, fastening the first edge of the second layer of the roofing membrane and the second edge of the first layer of the roofing membrane to the roofing substrate comprises moving at least one penetrating member: (i) through at least one strip of material, (ii) through the second layer of the roofing membrane, (iii) through the first layer of the roofing membrane, and (iv) into the roofing substrate. Moreover, reorienting the second layer of the roofing membrane comprises reorienting the second layer of the roofing membrane such that the second layer of the roofing membrane overlies the at least one strip of material.

In some embodiments, which may be used in conjunction with any of the above aspects and embodiments, the roofing substrate may comprise an eave, and the first edge of the first layer of the roofing membrane may be fastened to the eave along a length the eave. For example, the first edge of the first layer of the roofing membrane may be fastened to the eave by at least one of the following: an adhesive tape, an adhesive layer that is applied on a surface of the first layer of the roofing membrane, a penetrating member, a strip of material, or combinations thereof. In some of these embodiments, the first edge of the first layer of the roofing membrane may be fastened to a drip edge that is provided along the eave, in which case the first edge of the first layer of the roofing membrane may be fastened to the drip edge by an adhesive tape or an adhesive layer that is provided on a surface of the first layer of roofing membrane, among other possibilities.

In some embodiments, which may be used in conjunction with any of the above aspects and embodiments, the roofing substrate may comprise a rake, the first and second layers of the roofing membrane may be applied such that they extend to the rake, and the first and second layers of the roofing membrane may be fastened to the rake along a length the rake. In some of these embodiments, the first and second layers of the roofing membrane may be fastened to the rake by at least one of the following: an adhesive tape, an adhesive layer that is applied on a surface of one or both of the first and second layers of the roofing membrane, a penetrating member, a strip of material, or combinations thereof. In some of these embodiments, the first and second layers of the roofing membrane may be fastened to a drip edge that is provided along a length the rake, in which case the membrane may be fastened to the drip edge by an adhesive tape or an adhesive layer that is applied on a surface of one or both of the first and second layers of the roofing membrane, among other possibilities.

In some embodiments, which may be used in conjunction with any of the above aspects and embodiments, the methods may further include: applying an additional layer of the roofing membrane over the second layer of the roofing membrane along the length the roofing substrate, the additional layer of the roofing membrane having a first edge and a second edge opposite the first edge, such that the first edge of the additional layer of the roofing membrane overlies the second edge of the second layer of the roofing membrane, fastening the first edge of the additional layer of the roofing membrane and the second edge of the second layer of the roofing membrane to the roofing substrate using an additional fastener in an additional fastening zone along the length of the roofing substrate, and reorienting the additional layer of the roofing membrane such that the additional layer of the roofing membrane overlies the additional fastening zone and covers an additional portion of the roofing substrate adjacent the second portion of the roofing substrate. In some of these embodiments, the additional fastener, first fastener and second fastener may be the same. In some of these embodiments, the additional fastener, first fastener and second fastener may be different.

Other aspects of the present disclosure pertain to methods of applying a roofing membrane to a roofing substrate having a length and a width including: applying a first layer of the roofing membrane along the length of the roofing such that the first layer of the roofing membrane covers a first portion of the roofing substrate, the first layer of the roofing membrane having a first edge and a second edge opposite the first edge; fastening at least the first edge of the first layer of the roofing membrane to the roofing substrate along the length the roofing substrate using a first fastener; applying a second layer of the roofing membrane over the first layer of the roofing membrane along the length of the roofing substrate, the second layer of the roofing membrane having a first edge and a second edge opposite the first edge, such that the first edge of the second layer of the roofing membrane overlies the second edge of the first layer of the roofing membrane; fastening the first edge of the second layer of the roofing membrane and the second edge of the first layer of the roofing membrane to the roofing substrate using a second fastener in a first fastening zone along the length the roofing substrate; reorienting the second layer of the roofing membrane such that the second layer of the roofing membrane overlies the first fastening zone and covers a second portion of the roofing substrate adjacent the first portion of the roofing substrate; applying a third layer of the roofing membrane over the second layer of the roofing membrane along the length the roofing substrate, the third layer of the roofing membrane having a first edge and a second edge opposite the first edge, such that the first edge of the third layer of the roofing membrane overlies the second edge of the second layer of the roofing membrane; fastening the first edge of the third layer of the roofing membrane and the second edge of the second layer of the roofing membrane to the roofing substrate using a third fastener in an second fastening zone along the length of the roofing substrate; and reorienting the third layer of the roofing membrane such that the third layer of the roofing membrane overlies the second fastening zone and covers a third portion of the roofing substrate adjacent the second portion of the roofing substrate.

BRIEF DESCRIPTION OF THE DRAWINGS

FIG. 3A is a schematic illustration of an installation at an intersection of a rake and an eave that is created by a method in accordance with an embodiment of the present disclosure.

FIG. 3B is a detail of the installation of FIG. 3A in a region corresponding to the dashed circle shown in FIG. 3A.

FIG. 4A is a schematic illustration of an installation at an intersection of a rake and an eve that is created by a method in accordance with an embodiment of the present disclosure.

FIG. 4B is a detail of the installation of FIG. 4A in a region corresponding to the dashed circle shown in FIG. 4A.

Like reference numbers represent like parts throughout.

DETAILED DESCRIPTION

In some embodiments, the installation methods of this disclosure can deliver a significant cost saving and faster installation over conventional installation methods based on asphaltic shingles. In some embodiments, the installation methods of this disclosure do not require special tools, equipment, or extensive training.

Figure 1A:
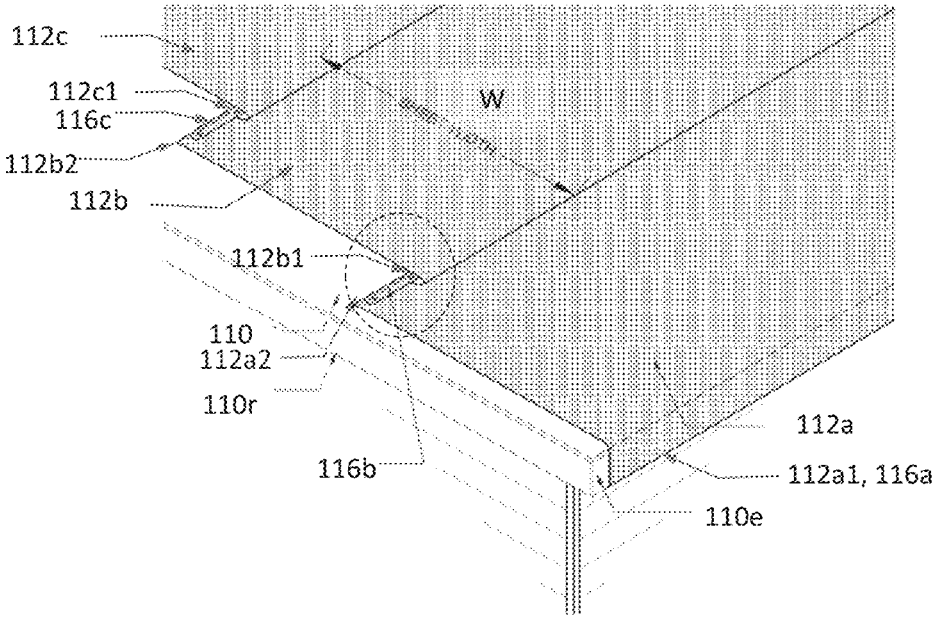
FIG. 1A is a schematic illustration of an installation that is created by a method in accordance with an embodiment of the present disclosure.
Figure 1B:
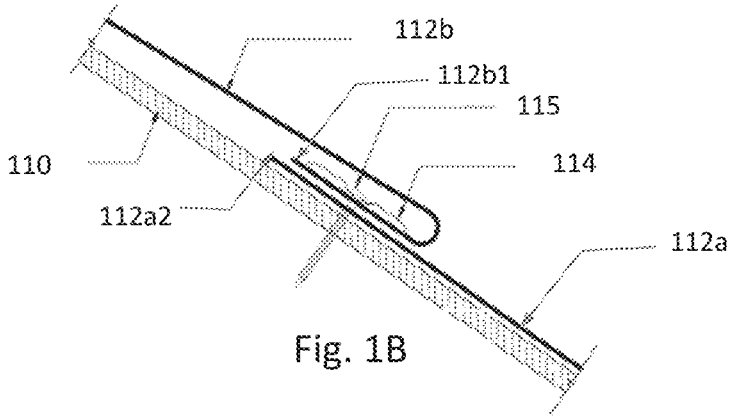
FIG. 1B is a detail of the installation of FIG. 1A in a region corresponding to the dashed circle shown in FIG. 1A.
Figure 1C:
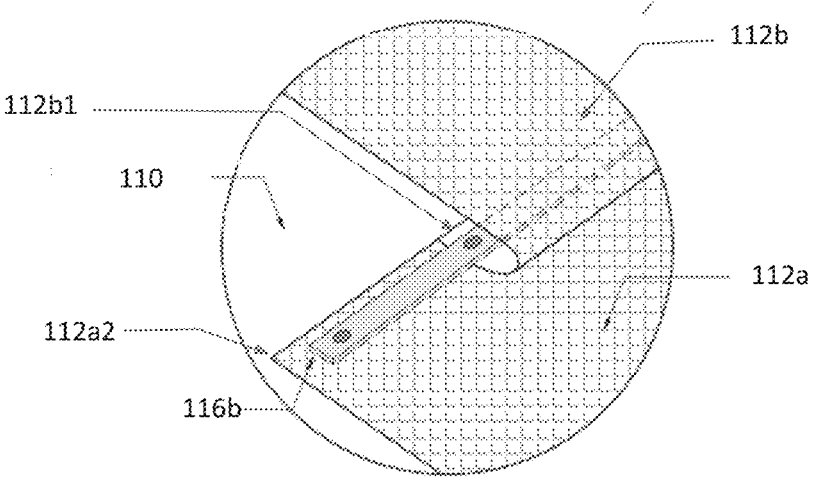
FIG. 1C is a cross-section taken along the region corresponding to the dashed circle shown in FIG. 1A.

With reference now to FIGS. 1A-1C, an installation is shown in which first, second and third layers of roofing membrane 112*a*, 112*b*, 112*c* are applied to a roofing substrate 110. In accordance with the method, a roofing membrane is obtained. A first layer of the roofing membrane 112*a* is first applied along a length of the roofing substrate 110 such that the first layer of the roofing membrane covers a first portion of the roofing substrate 110 along an eave 110*e*. The first layer of the roofing membrane 112*a* has a first edge 112*a*1 and a second edge 112*a*2 opposite the first edge 112*a*1. At least the first edge 112*a*1 of the first layer of the roofing membrane 112*a* is attached to the roofing substrate 110 at the eave 110*e* along the length the roofing substrate 110 using a first fastener 116*a*. In the embodiment shown, the first fastener 116*a* is an adhesive layer, although various other fasteners are possible as discussed below.

A second layer of the roofing membrane 112*b* is then applied over the first layer of the roofing membrane 112*a* along the length of the roofing substrate 110. The second layer of the roofing membrane 112*b* has a first edge 112*b*1 and a second edge 112*b*2 opposite the first edge 112*b*1. The second layer of the roofing membrane 112*b* is applied over the first layer of the roofing membrane 112*a* such that the first edge 112*b*1 of the second layer of the roofing membrane 112*b* overlies the second edge 112*a*2 of the first layer of the roofing membrane 112*a*.

After positioning the second layer of the roofing membrane 112*b* in this fashion, the first edge 112*b*1 of the second layer of the roofing membrane 112*b* and the second edge of the first layer 112*a*2 of the roofing membrane 112*a* are fastened to the roofing substrate 110 using a second fastener 116*b* in a fastening zone that extends along the length the roofing substrate 110.

In the embodiment shown, the second fastener 116*b* corresponds to one or more strips of material 114 (e.g., a batten bar in the embodiment shown) held in place by at least one penetrating member 115 (e.g., nails in the embodiment shown), although various other fastening mechanisms may be employed as discussed below. In this particular embodiment, the process whereby the first edge 112*b*1 of the second layer of the roofing membrane 112*b* and the second edge 112*a*2 of the first layer of the roofing membrane 112*b* are fastened to the roofing substrate 110 includes driving the at least one penetrating member 115: (i) through the one or more strips of material 114, (ii) through the second layer of the roofing membrane 112*b*, (iii) through the first layer of the roofing membrane 112*a*, and (iv) into the roofing substrate 110.

After fastening the first edge 112*b*1 of the second layer of the roofing membrane 112*b* and the second edge of the first layer 112*a*2 of the roofing membrane 112*a* to the roofing substrate 110, the second layer of the roofing membrane 112*b* is reoriented such that the second layer of the roofing membrane 112 overlies the second fastener 116*b* and further covers a second portion of the roofing substrate 110 adjacent the first portion of the roofing substrate 110 as seen in detail in FIGS. 1B-1C. In the particular embodiment of FIGS. 1A-1C, reorienting the second layer of the roofing membrane 112*b* includes reorienting the second layer of the roofing membrane 112*b* such that the second layer of the roofing membrane 112*b* overlies the at least one strip of material 114 and the at least one penetrating member 115. In this way, the roofing membrane protects the at least one strip of material 114 and the at least one penetrating member 115 from sunlight and rain exposure and aging.

In the embodiment shown, an additional layer of the roofing membrane 112*c* is applied over the second layer of the roofing membrane 112*b* along the length the roofing substrate 110. The additional layer of the roofing membrane 112*c* has a first edge 112*c*1 and a second edge (not shown) opposite the first edge 112*c*1. The additional layer of the roofing membrane 112*c* is applied over the second layer of the roofing membrane 112*b* such that the first edge 112*c*1 of the additional layer of the roofing membrane 112*c* overlies the second edge 112*b*2 of the second layer of the roofing membrane 112*b*. After applying the additional layer of the roofing membrane 112*c* over the second layer of the roofing membrane 112*b* in this manner, the first edge 112*c*1 of the additional layer of the roofing membrane 112*c* and the second edge 112*b*2 of the second layer of the roofing membrane 112*b* may be fastened to the roofing substrate 110 using an additional fastener 116*c* in an additional fastening zone along the length of the roofing substrate 110. Then, the additional layer of the roofing membrane 112*c* may be reoriented such that the additional layer of the roofing membrane 112*c* overlies the additional fastener 116*c* in the additional fastening zone and covers an additional portion of the roofing substrate 110 adjacent the second portion of the roofing substrate 110. This process can be repeated as needed until all or a desired portion of the roofing substrate 110 is covered.

The methods of the present disclosure may be applied to any roofing substrate including, but not limited to, roofing substrates in which the roof style is simple such as skillion/monoslope designs, gable and saltbox designs, and gambrel designs.

Roofing membranes in accordance with the present disclosure may be provided in any form including, but not limited to a rolled form or a folded form. In various embodiments, the roofing membrane may be provided in rolls of any desired width, for instance, ranging in width from 0.25 ft to 12 ft, for example, ranging from 0.25 ft to 0.5 ft to 1 ft to 2 ft to 3 ft to 4 ft to 6 ft to 8 ft to 10 ft to 12 ft (in other words, ranging between any two of the preceding values). In some embodiments, the roofing membrane may be delivered on site in a master roll which may be doled out and cut to fit the roof, removing all vertical seams in the system.

Any roofing membrane material may be used in the present disclosure. Non-limiting examples of single-ply roofing membrane materials that may be employed in embodiments of the present disclosure include membranes that have been widely used on low slope roofing and other applications. The membranes include polymeric membranes such as those based on thermoplastic polyolefin (TPO), polyvinyl chloride (PVC) and EPDM (EPDM), which have been widely used in roofing applications for two decades with superior weathering performance, sustainability and cost effectiveness. The membranes may comprise one or more sub-layers, may have differing top and bottom surfaces, and/or may include a reinforcing scrim or stabilizing material. In some embodiments, the membranes may include a base sub-layer including a woven or non-woven thermoplastic roofing underlayment, a layer of aluminum foil and a lamination coating between the underlayment and the foil. In some embodiments, the top sub-layer comprises at least one of: a thermoplastic polymer, UV additives, colorants, printed pattern, and combinations thereof. Example roofing membranes are illustrated in U.S. application Ser. No. 17/039,326, entitled "Composite Membrane for Building Applications," the entirety of which is hereby incorporated-by-reference.

Any fastener may be used in the present disclosure. Fasteners may be selected, for example, from one or more of the following, among others: adhesive tapes, adhesive layers that are applied to the roofing membrane and/or roofing substrate at the time of installation, adhesive layers that are applied to the membrane during the manufacturing process, and penetrating members (e.g., nails, screws, staples, etc.) which may or may not be used alone or in combination with strips of material (e.g., wood batten bars, terminational bars, polymeric bars, metallic bars, etc.).

Materials for use as adhesive layers include, for example, hot melt adhesives such as butyl hot melt adhesives and acrylic hot melt adhesives, silane based adhesives, one or two-part polyurethane adhesives, water-dispersed adhesives, solvent-dispersed adhesives, sprayable rubber adhesive, or adhesive tapes. Adhesives may be applied to the entire membrane surface of may be provided in adhesive patterns such as random spiral, grid, and chevron patterns. Where an adhesive layer is applied to the membrane during the manufacturing process, the adhesive layer may be protected by a peelable layer that can be readily removed from the adhesive layer at the time of installation (e.g., a "peel-and-stick" adhesive layer). Where an adhesive layer is applied to the membrane at the time of installation, it may be applied using static charge, roller, brush, spray, adhesive spreader, or other technique.

Further embodiments regarding eave installation methods will now be described with reference to FIGS. 2A-2C. As previously noted, during installation, at least the first edge 112*a*1 of the first layer of the roofing membrane 112*a* may be attached to the roofing substrate 110 at an eave using a first fastener 116*a*.

Figure 2A:
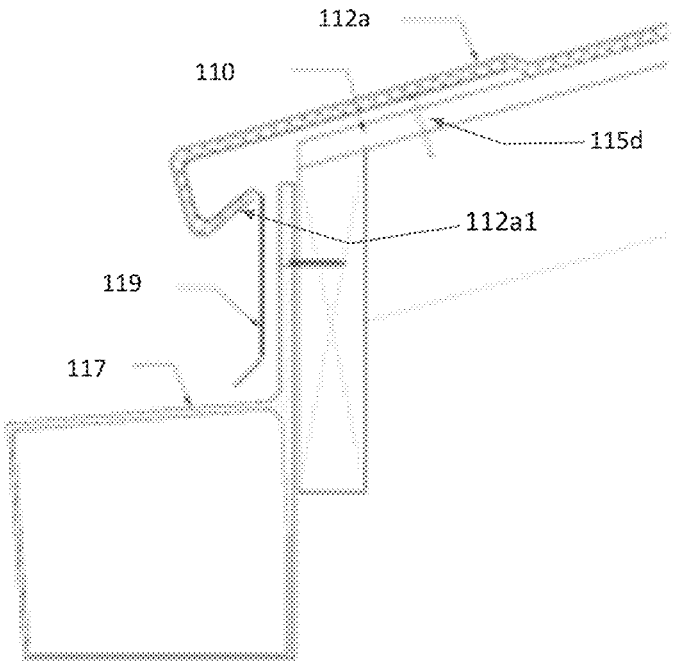
FIG. 2A is a schematic cross-sectional illustration of an installation at an eave that is created by a method in accordance with an embodiment of the present disclosure.

FIG. 2A is a schematic cross-sectional illustration of an installation at an eave in accordance with an embodiment of the present disclosure, which includes a gutter 117 and a drip edge 119 that is affixed to the roofing substrate 110 by a fastener (a nail 115*d* is shown). In FIG. 2A, the first edge 112*a*1 of the first layer of the roofing membrane 112*a* may be attached to the drip edge 119 using an adhesive tape or an adhesive layer (e.g., a peel-and-stick adhesive layer).

Figure 2B:
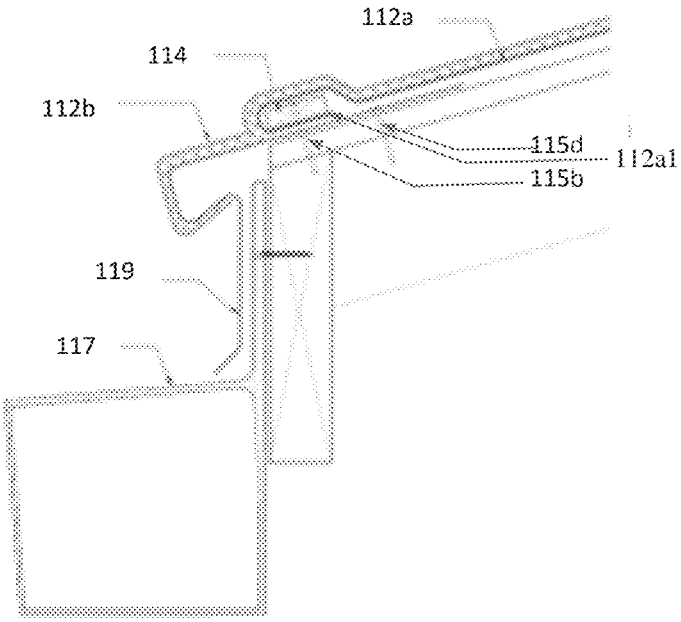
FIG. 2B is a schematic cross-sectional illustration of an installation at an eave that is created by another method in accordance with an embodiment of the present disclosure.

FIG. 2B is a schematic cross-sectional illustration of an installation at an eave in accordance with another embodiment of the present disclosure, which also includes a gutter 117 and a drip edge 119 that is affixed to the roofing substrate 110 by a fastener (a nail 115*d* is shown).

In FIG. 2B, a layer of the roofing membrane 112*a* is shown, in which a first edge 112*a*1 of the layer of the roofing membrane 112*a* is fastened to the roofing substrate 110 by a material 114 and fastener 115*b* (a nail is shown), which also more securely fixes the drip edge 119 to the roofing substrate 110. After securing the first edge 112*a*1 of the layer of the roofing membrane 112*a* by the material 114 and fastener 115*b*, the layer of the roofing membrane 112*a* is reoriented such that the layer of the roofing membrane 112*a* overlies the material 114 and fastener 115*b*, and further covers a portion of the roofing substrate 110 beyond the material 114. Then, an additional peel and stick layer of the roofing membrane 112*b* is applied over the layer of the roofing membrane 112*a* and over the eave edge adhering to the drip edge 119.

Figure 2C:
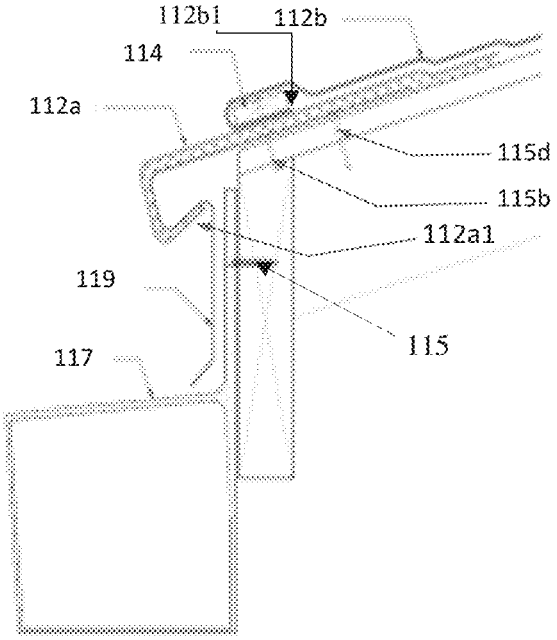
FIG. 2C is a schematic cross-sectional illustration of an installation at an eave that is created by yet another method in accordance with an embodiment of the present disclosure.

FIG. 2C is a schematic cross-sectional illustration of an installation at an eave in accordance with yet another embodiment of the present disclosure, which also includes a gutter 117 and a drip edge 119 that is affixed to the roofing substrate 110 by at least one penetrating member 115 (a nail is shown).

In FIG. 2C, a first edge 112*a*1 of a first layer of the roofing membrane 112*a* may be attached to the drip edge 119 using an adhesive tape or an adhesive layer (e.g., a peel and stick layer). A second layer of the roofing membrane 112*b* is also shown, in which a first edge 112*b*1 of the second layer of the roofing membrane 112*b* is fastened to the roofing substrate 110 by a material 114 and fastener 115*b* (which also further secures the drip edge 119 to the roofing substrate 110). After securing the first edge 112*b*1 of the second layer of the roofing membrane 112*b* by the material 114 and fastener 115*b*, the second layer of the roofing membrane 112*b* may be reoriented such that the second layer of the roofing membrane 112 overlies the material 114 and fastener 115*b*, and further covers an addition portion of the roofing substrate 110 beyond that covered by the first layer of the roofing membrane 112*a*.

Still further embodiments regarding rake installation methods will now be described with reference to FIGS. 3A-3B and 4A-4B. Although not shown in FIGS. 1A-1C, where the roofing substrate 110 comprises a rake 110*r*, the layers of roofing membrane (first, second, and third layers of the roofing membrane 112*a*, 112*b*, 112*c* are shown in one or more of FIGS. 3A, 3B, 4A, and 4B) may be applied such that the layers of roofing membrane extend to the rake 110*r* where the layers of roofing membrane are fastened to rake 110*r* along a length thereof.

In some embodiments, the layers of the roofing membrane 112*a*, 112*b*, 112*c* may be fastened to the rake 110*r* using one or more of the following: adhesive tape, an adhesive layer that is applied on the layers of the roofing membrane 112*a*, 112*b*, 112*c*, penetrating members, and one or more strips of material.

For example, FIGS. 3A-3B are schematic illustrations of an installation at a rake in accordance with an embodiment of the present disclosure wherein the layers of the roofing membrane 112*a*, 112*b*, 112*c* may be fastened to the rake 110*r* by a strip of material 114 (e.g., a term bar) and at least one penetrating member 115 (e.g., nails, screws, etc.).

As another example, FIGS. 4A-4B are schematic illustrations of an installation at a rake in accordance with another embodiment of the present disclosure, which includes a drip edge 119 that is affixed to the roof substrate by a fastener (not shown). In FIGS. 4A-4B, the layers of the roofing membrane 112*a*, 112*b*, 112*c* may be fastened to the drip edge 119 by a fastener 116 (e.g., an adhesive cover tape). The layers of the roofing membrane 112*a*, 112*b*, 112*c* may also be fastened to the drip edge 119 by an adhesive layer that is applied to a surface of the layers of the roofing membrane 112*a*, 112*b*, 112*c*, a surface of the drip edge, or both.

The above and other features will become apparent from the Example to follow.

The roofing membrane used for the Example is a layered composite membrane in which a 6 mil coating sub-layer was made of 100 parts of a blend of polypropylene copolymers and polyethylene. Other ingredients including 2-8 parts UV and thermal stabilizers master batch, 1-5 parts color concentrate and 15-50 parts calcium carbonate. The ingredients were mixed in an extruder at 170° C. and extruded through a sheet die at 235° C. on a 6-mil base sub-layer at 96 g/m$^2$ weight to form a 12 mil layered composite membrane. The layered composite membrane was tested as detailed in the following Example.

Example 1. Time and Motion Study

Roofing materials were installed on outdoor roofing decks at a temperature of 38° F. The outdoor roofing deck size is 16'×24' with a 4:12 slope.

On a first deck, control asphalt shingles were mechanically applied.

Figure 5A:
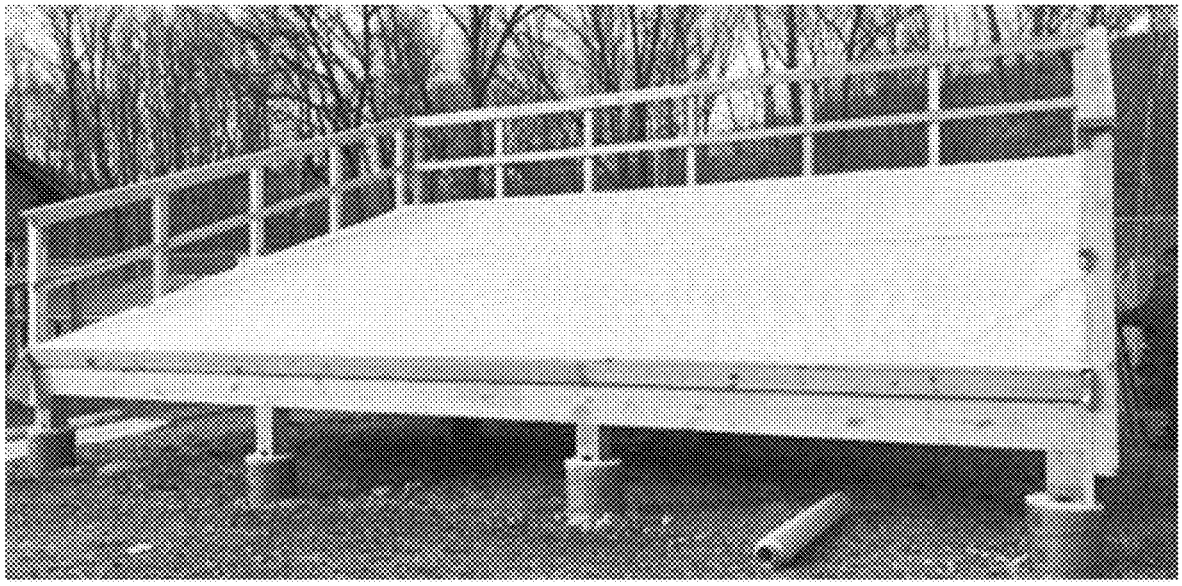
FIGS. 5A and 5B show a batten at eave installation of a layered composite membrane, in accordance with an embodiment of the present disclosure.
Figure 5B:
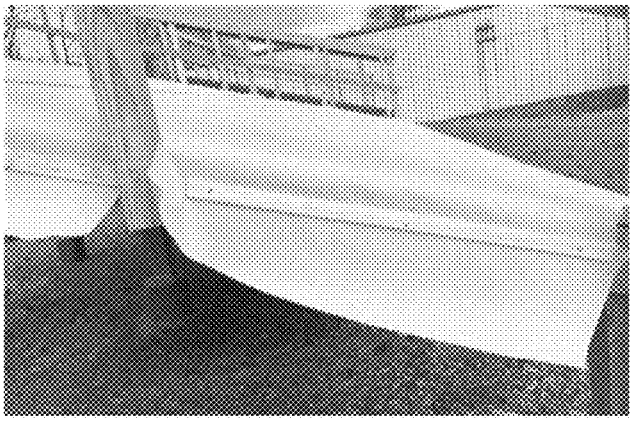

On a second deck, an 8' layered composite membrane and wood battens for mechanical attachment were applied horizontally by 3 person team using an embodiment of the method of the present disclosure. The layered composite membrane was installed with batten at eave (BAE) as a first course option, which includes a drip edge at the eave of the structure. See, e.g., FIG. 5A (front view) and FIG. 5B (side view).

On a third deck, a 4' layered composite membrane was applied in a like manner in accordance with an embodiment of the present disclosure.

Figure 6:
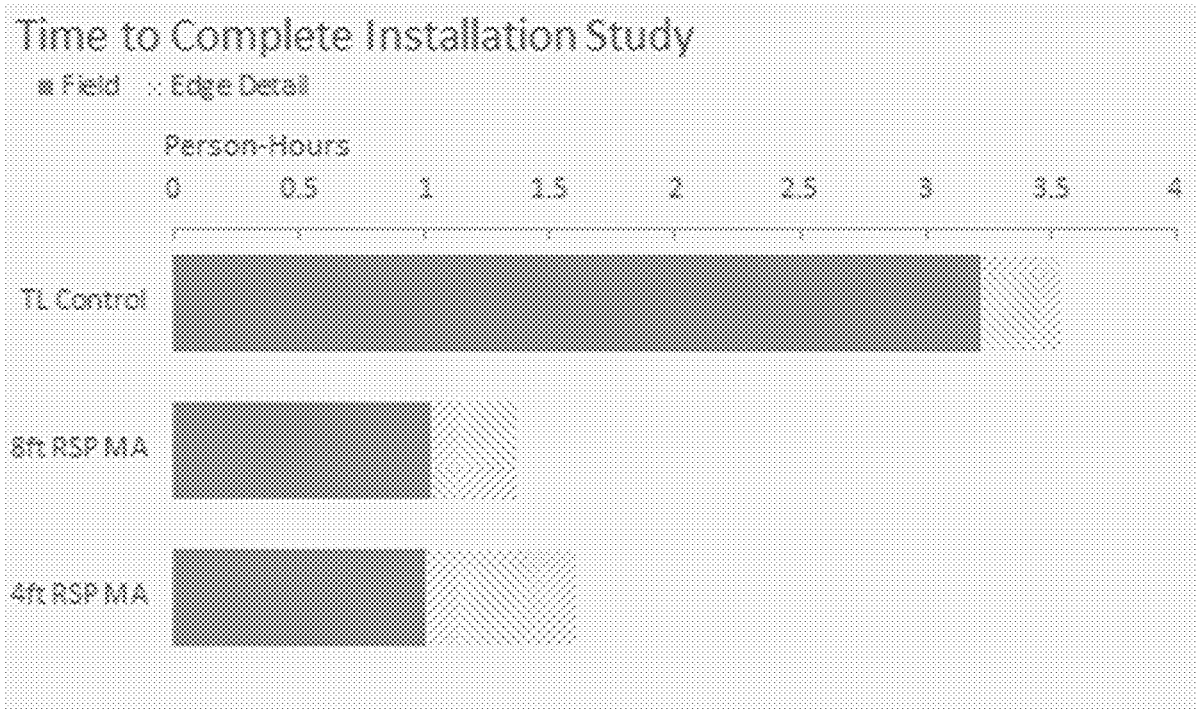
FIG. 6 illustrates time to completion for an asphalt shingle deck installation and two deck installations using layered composite membranes in accordance with the present disclosure.

Time to completion for each of these systems are shown in FIG. 6, which shows a significant overall time savings for the 8' layered composite membrane (8 ft RSP MA) in accordance with an embodiment of the present disclosure and the 4' layered composite membrane (4 ft RSP MA) in accordance with an embodiment of the present disclosure, relative to the asphalt shingle installation (TL Control), particularly in the field portion of the installation. In this time-motion study, the 8' & 4' wide layered composite membrane shows >50% installation time saving over conventional asphalt shingles.

Example 2. Wind Driven Rain Testing

The wind driven rain resistance testing was performed by mimicking industry standard ASTM D3161 Standard Test Method for Wind-Resistance of Steep Slope Roofing Products (Fan-Induced Method) and Miami Dade County TAS 100A-95 for a layered composite membrane mounted on 4'×5' plywood deck in accordance with the present disclosure at a 2:12 slope. Two installation methods were tested: mechanically attached with wood batten and peel-and-stick adhered product design. The standard testing of wind blowing calls for 15 minutes at 35 mph, 70 mph, and 90 mph respectively followed by 5 minutes at 110 mph. In each case, the residential single ply (RSP) installation passed the 110 mph rating.

Example 3. Hail Impact Resistance Study

The hail impact resistance of a layered composite membrane in accordance with the present disclosure was measured by mimicking industry standard FM Approvals (FM) 4473 Test Standard of Impact Resistance of Testing of Rigid Roofing Materials by impacting with Freezer Ice Balls in a small scale test and Underwriters Laboratories (UL) 2218 Standard for Impact Resistance of Prepared Roof Covering Materials, with the layered composite membrane providing a Class 3 rating. It is superior to asphalt shingle.

Example 4. Aging Study

The 12-mil layer composite membrane was exposed outdoor in PA. Compared to a 10-mil retailed plastic tarp, the layer composite membrane remains 100% breaking strength retention and no surface cracking while the green tarp shows surface cracking after 7-month outdoor exposure.

The inventive composite membrane was tested in artificial accelerated Xenon Arc Weather-O-Meter per ASTM D6878/G155. The 12-mil thermoplastic polyolefin composite membrane passes 6,300 KJ/nm·$m^2$ without 7× surface cracking. The 15-mil posted-consumer recycled PP (KW Plastics KW308A) top coated membrane passes 20,000 KJ/nm·$m^2$ without 7× surface cracking.

Table 1 illustrates a comparison of physical properties between asphaltic shingle roof materials versus the inventive composite membrane described herein.

TABLE 1

| Building Material Properties | Test Method | Conventional Roof Cover Asphalt Shingles | Inventive Example Polyolefin Composite Membrane |
|---|---|---|---|
| Thickness (mils) | ASTM D751 | ≥100 | 12 |
| Weight (g/SF) | ASTM D751 | >317 | 18.5 |
| Weather Resistance | AC 438*/ ASTM G155 @ Irradiance: 0.70 W/$m^2$ @ 340 nm | >2000 hrs, no visual surface crack | >2333 hrs, no surface crack with 7x magnification |
| Roof Installation Method | | Mechanical nailing | Mechanical attached & Peel & Stick self-adhered |
| Wind-driven Rain Resistance | AC 438/ TS-100** | Pass at 2:12 | Pass at 110 mph wind @2&½ Slope |

*AC 438 (International Code Council) - Acceptance Criteria For Alternative Asphalt Roofing Shingles
**Florida Building Code Test Protocol TAS-100

As can be seen in Table 1, the inventive material provides weight reductions and can be installed in a relatively shorter time while meeting or exceeding the capabilities of a conventional roofing material such as asphalt shingles.

Conventional terms in the fields of materials science and engineering have been used herein. The terms are known in the art and are provided only as a non-limiting example for convenience purposes. Accordingly, the interpretation of the corresponding terms in the claims, unless stated otherwise, is not limited to any particular definition. Thus, the terms used in the claims should be given their broadest reasonable interpretation.

Although specific embodiments have been illustrated and described herein, it will be appreciated by those of ordinary skill in the art that any arrangement that is adapted to achieve the same purpose may be substituted for the specific embodiments shown. Many adaptations will be apparent to those of ordinary skill in the art. Accordingly, this application is intended to cover any adaptations or variations.

The above detailed description includes references to the accompanying drawing, which form a part of the detailed description. The drawing shows, by way of illustration, specific embodiments that may be practiced. These embodiments are also referred to herein as "examples." Such examples may include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments may be used, such as by one of ordinary skill in the art upon reviewing the above description. The Abstract is provided to comply with 37 C.F.R. § 1.72(b), to allow the reader to quickly ascertain the nature of the technical disclosure and is submitted with the understanding that it will not be used to interpret or limit the scope or meaning of the claims.

In this Detailed Description, various features may have been grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments may be combined with each other in various combinations or permutations.

The scope of the embodiments should be determined with reference to the appended claims, along with the full scope of equivalents to which such claims are entitled.

Embodiments

Embodiment 1. A method, comprising: obtaining a roofing membrane; applying a first layer of the roofing membrane along a length of a roofing substrate such that the first layer covers a first portion of the roofing substrate, wherein the first layer of the roofing membrane having a first edge and a second edge opposite the first edge; fastening at least the first edge of the first layer of the roofing membrane to the roofing substrate along the length the roofing substrate using a first fastener; applying a second layer of the roofing membrane over the first layer of the roofing membrane along the length of the roofing substrate, wherein the second layer of the roofing membrane having a first edge and a second edge opposite the first edge, such that the first edge of the second layer of the roofing membrane overlies the second edge of the first layer of the roofing membrane; fastening the first edge of the second layer of the roofing membrane and the second edge of the first layer of the roofing membrane to the roofing substrate using a second fastener in a fastening zone along the length the roofing substrate; and reorienting the second layer of the roofing membrane such that the second layer of the roofing membrane: overlies the fastening zone, and covers a second portion of the roofing substrate adjacent the first portion of the roofing substrate.

Embodiment 2. The method of embodiment 1, wherein the applying the first layer of the roofing membrane comprises unrolling the first layer of the roofing membrane from a first roll and wherein the applying the second layer of the roofing membrane comprises unrolling the second layer of the roofing membrane onto the roofing substrate from a second roll.

Embodiment 3. The method of embodiment 2, wherein the first and second rolls are the same.

Embodiment 4. The method of embodiment 2, wherein the first and second rolls are different.

Embodiment 5. The method of any of embodiments 1-4, wherein a width of the roofing membrane ranges from 0.25 feet to 12 feet.

Embodiment 6. The method of any of embodiments 1-5, wherein the roofing membrane is a single-ply reinforced or unreinforced roofing membrane.

Embodiment 7. The method of any of embodiments 1-5, wherein the roofing membrane comprises base sub-layers comprising a thermoplastic polymer, a foil and a lamination coating between the thermoplastic polymer and the foil, and a top sub-layer comprising at least one of: a thermoplastic polymer, UV additives, colorants, a printed pattern, or combinations thereof.

Embodiment 8. The method of any of embodiments 1-7, wherein the first and second fasteners are the same.

Embodiment 9. The method of any of embodiments 1-7, wherein the first and second fasteners are different.

Embodiment 10. The method of any of embodiments 1-9, wherein the first and second fasteners are independently selected from one or more of the following: an adhesive tape, an adhesive layer that is applied on a surface of one or both of the first and second layers of the roofing membrane, a penetrating member, and a strip of material.

Embodiment 11. The method of embodiment 10, wherein the penetrating member is selected from nails, screws and staples.

Embodiment 12. The method of any of embodiments 1-11, wherein the fastening the first edge of the second layer of the roofing membrane and the second edge of the first layer of the roofing membrane to the roofing substrate comprises moving at least one penetrating member: (i) through at least one strip of material, (ii) through the second layer of the roofing membrane, and (iii) through the first layer of the roofing membrane and (iv) into the roofing substrate, and wherein the reorienting the second layer of the roofing membrane comprises reorienting the second layer of the roofing membrane such that the second layer of the roofing membrane overlies the at least one strip of material.

Embodiment 13. The method of any of embodiments 1-12, wherein the roofing substrate comprises an eave, and wherein the first edge of the first layer of the roofing membrane is fastened to the eave along a length the eave.

Embodiment 14. The method of embodiment 13, wherein the first edge of the first layer of the roofing membrane is fastened to the eave by at least one of the following: an adhesive tape, an adhesive layer that is applied on a surface of the first layer of the roofing membrane, a penetrating member, a strip of material, or combinations thereof.

Embodiment 15. The method of any of embodiments 13-14, wherein the first edge of the first layer of the roofing membrane is fastened to a drip edge that is provided along the eave.

Embodiment 16. The method of embodiment 15, wherein the first edge of the first layer of the roofing membrane is fastened to the drip edge by an adhesive tape or an adhesive layer that is provided on a surface of the first layer of roofing membrane.

Embodiment 17. The method of any of embodiments 1-16, wherein the roofing substrate comprises a rake, wherein the first and second layers of the roofing membrane are applied such that they extend to the rake, and wherein the first and second layers of the roofing membrane are fastened to the rake along a length the rake.

Embodiment 18. The method of embodiment 17, wherein the first and second layers of the roofing membrane are fastened to the rake by at least one of the following: an adhesive tape, an adhesive layer that is applied on a surface of one or both of the first and second layers of the roofing membrane, a penetrating member, a strip of material, or combinations thereof.

Embodiment 19. The method any of embodiments 17-18, wherein the first and second layers of the roofing membrane are fastened to a drip edge that is provided along a length the rake.

Embodiment 20. The method of embodiment 19, wherein the membrane is fastened to the drip edge by an adhesive tape or an adhesive layer that is applied on a surface of one or both of the first and second layers of the roofing membrane.

Embodiment 21. The method of any of embodiments 10, 14, 16, 18 and 20, wherein the adhesive layer is a self-adhered peel-and-stick layer.

Embodiment 22. The method of any of embodiments 10, 14, 16 and 18, wherein the strip of material comprises wood, metal, a polymeric material, or a combination thereof.

Embodiment 23. The method of embodiment 1, further comprising: applying an additional layer of the roofing membrane over the second layer of the roofing membrane along the length the roofing substrate, the additional layer of the roofing membrane having a first edge and a second edge opposite the first edge, such that the first edge of the additional layer of the roofing membrane overlies the second edge of the second layer of the roofing membrane; fastening the first edge of the additional layer of the roofing membrane and the second edge of the second layer of the roofing membrane to the roofing substrate using an additional fastener in an additional fastening zone along the length of the roofing substrate; and reorienting the additional layer of the roofing membrane such that the additional layer of the roofing membrane overlies the additional fastening zone and covers an additional portion of the roofing substrate adjacent the second portion of the roofing substrate.

Embodiment 24. The method of embodiment 23, wherein the additional fastener, first fastener and second fastener are the same.

Embodiment 25. The method of embodiment 23, wherein the additional fastener, first fastener and second fastener are different.

Embodiment 26. A method, comprising: obtaining a roofing membrane; applying a first layer of the roofing membrane along a length of a roofing substrate such that the first layer covers a first portion of the roofing substrate, wherein the first layer of the roofing membrane having a first edge and a second edge opposite the first edge; fastening at least the first edge of the first layer of the roofing membrane to the roofing substrate along the length the roofing substrate using a first fastener; applying a second layer of the roofing membrane over the first layer of the roofing membrane along the length of the roofing substrate, wherein the second layer of the roofing membrane having a first edge and a second edge opposite the first edge, such that the first edge of the second layer of the roofing membrane overlies the second edge of the first layer of the roofing membrane; fastening the first edge of the second layer of the roofing membrane and the second edge of the first layer of the roofing membrane to the roofing substrate using a second fastener in a first fastening zone along the length the roofing substrate; reorienting the second layer of the roofing membrane such that the second layer of the roofing membrane: overlies the first fastening zone, and covers a second portion of the roofing substrate adjacent the first portion of the roofing substrate; applying a third layer of the roofing membrane over the second layer of the roofing membrane along the length the roofing substrate, wherein the third layer of the roofing membrane having a first edge and a second edge opposite the first edge, such that the first edge of the third layer of the roofing membrane overlies the second edge of the second layer of the roofing membrane; fastening the first edge of the third layer of the roofing membrane and the second edge of the second layer of the roofing membrane to the roofing substrate using a third fastener in a second fastening zone along the length of the roofing substrate; and reorienting the third layer of the roofing membrane such that the third layer of the roofing membrane: overlies the second fastening zone, and covers a third portion of the roofing substrate adjacent the second portion of the roofing substrate.

Conventional terms in the fields of materials science and engineering have been used herein. The terms are known in the art and are provided only as a non-limiting example for convenience purposes. Accordingly, the interpretation of the corresponding terms in the claims, unless stated otherwise, is not limited to any particular definition. Thus, the terms used in the claims should be given their broadest reasonable interpretation.

Although specific embodiments have been illustrated and described herein, it will be appreciated by those of ordinary skill in the art that any arrangement that is adapted to achieve the same purpose may be substituted for the specific embodiments shown. Many adaptations will be apparent to those of ordinary skill in the art. Accordingly, this application is intended to cover any adaptations or variations.

The above detailed description includes references to the accompanying drawing, which form a part of the detailed description. The drawing shows, by way of illustration, specific embodiments that may be practiced. These embodiments are also referred to herein as "examples." Such examples may include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

Any and all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments may be used, such as by one of ordinary skill in the art upon reviewing the above description. The Abstract is provided to comply with 37 C.F.R. § 1.72(b), to allow the reader to quickly ascertain the nature of the technical disclosure and is submitted with the understanding that it will not be used to interpret or limit the scope or meaning of the claims.

In this Detailed Description, various features may have been grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments may be combined with each other in various combinations or permutations. The scope of the embodiments should be determined with reference to the appended claims, along with the full scope of equivalents to which such claims are entitled.

What is claimed is:

1. A method, comprising:

obtaining a roll of a roofing membrane;

applying a first layer of the roofing membrane along a length of a roofing substrate such that the first layer covers a first portion of the roofing substrate, wherein the first layer of the roofing membrane having a first edge and a second edge opposite the first edge;

fastening at least the first edge of the first layer of the roofing membrane to the roofing substrate along the length the roofing substrate using a first fastener;

applying a second layer of the roofing membrane over the first layer of the roofing membrane along the length of the roofing substrate, wherein the second layer of the roofing membrane having a first edge and a second edge opposite the first edge, such that the first edge of the second layer of the roofing membrane overlies the second edge of the first layer of the roofing membrane;

fastening the first edge of the second layer of the roofing membrane and the second edge of the first layer of the roofing membrane to the roofing substrate using a second fastener, the second fastener comprising:

a batten bar disposed in a fastening zone along the length of the roofing substrate, the batten bar being separate from the second layer of the roofing membrane and extending beyond an edge of the second layer of the roofing membrane, and at least one penetrating member, the penetrating member penetrating the batten bar, the first layer of the roofing membrane, the second layer of the roofing membrane, and the roofing substrate; and reorienting the second layer of the roofing membrane such that the second layer of the roofing membrane:

a) folds over the batten bar;

b) overlies the fastening zone, and c) covers a second portion of the roofing substrate adjacent the first portion of the roofing substrate.

2. The method of claim 1, wherein the applying the first layer of the roofing membrane comprises unrolling the first layer of the roofing membrane from the roll, and wherein the applying the second layer of the roofing membrane comprises unrolling the second layer of the roofing membrane onto the roofing substrate from the roll.

3. The method of claim 1, wherein a width of the roofing membrane ranges from 0.25 feet to 12 feet.

4. The method of claim 1, wherein the roofing membrane is a single-ply reinforced or unreinforced roofing membrane.

5. The method of claim 1, wherein the roofing membrane comprises:

base sub-layers comprising a thermoplastic polymer, a foil and a lamination coating between the thermoplastic polymer and the foil, and a top sub-layer comprising at least one of: a thermoplastic polymer, UV additives, colorants, a printed pattern, or combinations thereof.

6. The method of claim 1, wherein the first fastener comprises: an adhesive tape, an adhesive layer that is applied on a surface of one or both of the first and second layers of the roofing membrane, a penetrating member, or a strip of material.

7. The method of claim 1, wherein the penetrating member is selected from nails, screws, or staples.

8. The method of claim 1, wherein the roofing substrate comprises an eave, and wherein the first edge of the first layer of the roofing membrane is fastened to the eave along a length of the eave.

9. The method of claim 8, wherein the first edge of the first layer of the roofing membrane is fastened to the eave by at least one of: an adhesive tape, an adhesive layer that is applied on a surface of the first layer of the roofing membrane, a penetrating member, a strip of material, or combinations thereof.

10. The method of claim 9, wherein the first edge of the first layer of the roofing membrane is fastened to a drip edge that is provided along the eave.

11. The method of claim 10, wherein the first edge of the first layer of the roofing membrane is fastened to the drip edge by an adhesive tape or an adhesive layer that is provided on a surface of the first layer of the roofing membrane.

12. The method of claim 1, wherein the roofing substrate comprises a rake, wherein the first and second layers of the roofing membrane are applied such that they extend to the rake, and wherein the first and second layers of the roofing membrane are fastened to the rake along a length of the rake.

13. The method of claim 12, wherein the first and second layers of the roofing membrane are fastened to the rake by at least one of: an adhesive tape, an adhesive layer that is applied on a surface of one or both of the first and second layers of the roofing membrane, a penetrating member, a strip of material, or combinations thereof.

14. The method of claim 12, wherein the first and second layers of the roofing membrane are fastened to a drip edge that is provided along a length of the rake.

15. The method of claim 14, wherein the membrane is fastened to the drip edge by an adhesive tape or an adhesive layer that is applied on a surface of one or both of the first and second layers of the roofing membrane.

16. A method, comprising:

obtaining a roll of a roofing membrane;

applying a first layer of the roofing membrane along a length of a roofing substrate such that the first layer covers a first portion of the roofing substrate, wherein the first layer of the roofing membrane having a first edge and a second edge opposite the first edge;

fastening at least the first edge of the first layer of the roofing membrane to the roofing substrate along the length the roofing substrate using a first fastener;

applying a second layer of the roofing membrane over the first layer of the roofing membrane along the length of the roofing substrate, wherein the second layer of the roofing membrane having a first edge and a second edge opposite the first edge, such that the first edge of the second layer of the roofing membrane overlies the second edge of the first layer of the roofing membrane;

fastening the first edge of the second layer of the roofing membrane and the second edge of the first layer of the roofing membrane to the roofing substrate using a second fastener, the second fastener comprising:

a batten bar disposed in a first fastening zone along the length of the roofing substrate, the batten bar being separate from the second layer of the roofing membrane and extending beyond an edge of the second layer of the roofing membrane, and at least one penetrating member, the penetrating member penetrating the batten bar, the first layer of the roofing membrane, the second layer of the roofing membrane, and the roofing substrate;

reorienting the second layer of the roofing membrane such that the second layer of the roofing membrane:

a) folds over the batten bar;

b) overlies the first fastening zone, and c) covers a second portion of the roofing substrate adjacent the first portion of the roofing substrate;

applying a third layer of the roofing membrane over the second layer of the roofing membrane along the length the roofing substrate, wherein the third layer of the roofing membrane having a first edge and a second edge opposite the first edge, such that the first edge of the third layer of the roofing membrane overlies the second edge of the second layer of the roofing membrane;

fastening the first edge of the third layer of the roofing membrane and the second edge of the second layer of the roofing membrane to the roofing substrate using a third fastener in a second fastening zone along the length of the roofing substrate; and reorienting the third layer of the roofing membrane such that the third layer of the roofing membrane:

a) overlies the second fastening zone, and b) covers a third portion of the roofing substrate adjacent the second portion of the roofing substrate.

17. The method of claim 16, wherein the first fastener and the third fastener are different.

* * * * *